US006357076B1

(12) United States Patent
Lee

(10) Patent No.: US 6,357,076 B1
(45) Date of Patent: Mar. 19, 2002

(54) SUCTION NOZZLE UNIT FOR VACUUM CLEANER

(75) Inventor: Byung-jo Lee, Kwangju (KR)

(73) Assignee: Samsung Kwang-Ju Electronics Co., Ltd. (KR)

( * ) Notice: Subject to any disclaimer, the term of this patent is extended or adjusted under 35 U.S.C. 154(b) by 0 days.

(21) Appl. No.: 09/592,989

(22) Filed: Jun. 13, 2000

(30) Foreign Application Priority Data

Oct. 27, 1999 (KR) ..... 99-46962

(51) Int. Cl.[7] ..... A47L 5/34
(52) U.S. Cl. ..... 15/354; 15/361
(58) Field of Search ..... 15/354, 361

(56) References Cited

U.S. PATENT DOCUMENTS 1,900,692 A * 3/1933 Clements ..... 15/354 X
2,107,016 A * 2/1938 Snyder ..... 15/354 X
3,262,147 A * 7/1966 Waters et al. ..... 15/354
3,683,448 A * 8/1972 Lagerstrom et al. ..... 15/354
3,959,846 A 6/1976 Yasuda
4,083,079 A * 4/1978 Vermillion ..... 15/354
4,199,839 A * 4/1980 Martinec ..... 15/354
4,446,594 A * 5/1984 Watanabe et al. ..... 15/354 X
5,522,114 A 6/1996 Allison

* cited by examiner

*Primary Examiner*—Chris K. Moore
(74) *Attorney, Agent, or Firm*—Larson & Taylor, PLC

(57) ABSTRACT

A suction nozzle unit for a vacuum cleaner unit includes a casing formed with a suction inlet, a pair of front wheels located at the front of the casing, and a pair of rear wheels located at the rear of the casing. The suction nozzle unit also includes a shaft pin for rotatably supporting the front wheels and an arrangement, for moving the casing up and down relative to the shaft pin so as to raise and lower the front end of the casing relative to the surface to be vacuumed. As a result the front end of the unit can be moved up and down as necessary depending, for example, on the depth of pile of a carpet being vacuumed, thereby increasing ability of the unit to travel over the carpet during vacuuming.

6 Claims, 7 Drawing Sheets

SUCTION NOZZLE UNIT FOR VACUUM CLEANER

FIELD OF THE INVENTION

The present invention relates to a suction nozzle unit for a vacuum cleaner, and more particularly, a suction nozzle unit for a vacuum cleaner having a mechanism for lifting up a front portion of the suction nozzle unit.

DESCRIPTION OF RELATED ART

The invention can perhaps be best understood by first considering a conventional vacuum cleaner as illustrated in FIGS. 5 to 7. Referring to FIG. 5, a conventional vacuum cleaner 90 is comprised of a cleaner body 91, inside of which a suction fan (not shown) and a filter (not shown) are installed, a suction nozzle unit 101 for sucking dust and debris from a surface to be cleaned, and a suction pipe 93 and a connection hose 97, both of which connect the suction nozzle unit 101 to the cleaner body 91.

The cleaner body 91 is provided with a pair of rollers 92 and the suction nozzle unit 101 is provided with a pair of front wheels 109 and a pair of rear wheels 106. The roller 92, the front and rear wheels 109 and 106 respectively enable the cleaner body 91 and the suction nozzle unit 101 to be moved over the surface to be cleaned. A handle 95 for a user is connected between the suction pipe 93 and the connection hose 97. By grasping the handle 95, the user can move the suction nozzle unit 101 on the surface to be cleaned. When the suction nozzle unit 101 is moved, dust and debris attached to the surface to be cleaned are sucked into the suction nozzle unit 101 by the suction force from the suction fan (not shown) installed in the cleaner body 91 and then moved into the cleaner body 91 through the suction pipe 93 and the connection hose 97.

Referring to FIGS. 6 and 7, the conventional suction nozzle unit 101 is comprised of a casing 103 defining the outer appearance of the suction nozzle unit 101, the above mentioned pair of front wheels 109 and pair of rear wheels 106, for enabling the user to move the suction nozzle unit 101 over the surface to be cleaned, and a connector 107 to which the aforementioned suction pipe 93 is coupled.

The casing 103 is comprised of a lower casing 110 and an upper casing 120 coupled to the lower casing 110. In the front bottom part of the lower casing 110 is formed a suction inlet 111 for sucking dust and debris from the surface to be cleaned. In the back of the suction inlet 111 are located a pair of oppositely disposed, substantially L-shaped partitioning walls 124. Between side wall portions 124*a* of the partitioning walls 124 is formed a suction duct 113 which serves as a passageway for the dust and debris sucked through the suction inlet 111. The top of the suction duct -113 is covered with the duct cover 123. In the back of the suction duct 113 is positioned a connector receiving part 125, with which the connector 107 is rotatably coupled.

Between a front wall 110*a* and side walls 110*b* of the lower casing 110, and front wall portions 124*b* of the partitioning walls 124 is formed a brush receiving part 115 in which a brush member 127 for removing the dust and debris from carpet pile or fiber 89 of a carpet 87 is rotatably installed. The brush member 127 is rotated by a brush motor (not shown).

In the front and back sides of the lower casing 110 are respectively installed wheel coupling parts 117 with which the front and rear wheels 109 and 106 are coupled.

With this configuration, the suction nozzle unit 101 sucks dust and debris from the surface to be cleaned by the suction force generated from the suction fan (not shown) installed in the cleaner body 91 and through the suction inlet 111. The dust and debris vacuumed or sucked up from the carpet is transported into the cleaner body 91 through the suction duct 113 and the connector 107.

A disadvantage of this kind of a conventional suction nozzle unit 101 is that the height of the bottom face of the lower casing 110 relative to the surface to be cleaned is so small that the suction inlet 111 closely contacts the surface to be cleaned, and therefore, movement of the suction nozzle unit 101 is restricted depending on the shape or nature of the surface to be cleaned. This is a particular problem in cleaning the deep pile carpet 87 depicted in FIG. 7, wherein all or a part of the carpet fibers 89 of the carpet 87 may be directed toward the suction inlet 111 of the lower casing 110, thereby causing resistance against the movement of the suction nozzle unit 101. Further, in the case of the deep pile carpet 87, i.e., a carpet having relatively long carpet fibers as indicated 89, stronger resistance will be caused against the movement of the suction nozzle unit 101. For all these reasons, movement of the suction nozzle unit 101 can be difficult when vacuuming deep pile carpets. In addition, the user must exert himself or herself more vigorously to move the suction nozzle unit 101 in order to overcome the resistance against movement exerted on the suction nozzle unit 101, and as a consequence, the job of vacuuming can become tiring and burdensome.

SUMMARY OF THE INVENTION

An important object of the present invention is to overcome the above-described problems and, to this end, a suction nozzle unit is provided for a vacuum cleaner which enables easier and more convenient vacuuming by reducing the resistance against the movement of the suction nozzle unit so as to enhance the movability thereof.

This object of the present invention is accomplished through the provision of on an improved suction nozzle unit for a vacuum cleaner comprising a casing including a suction inlet, a pair of front wheels at the front of the casing and a pair of rear wheels at the rear of the casing, wherein the suction nozzle unit further comprises a shaft pin for rotatably supporting the front wheels, and means for moving the casing up and down relative to the shaft pin so as to vary the height of the front end of the casing relative to the surface to be vacuumed(e.g., a carpet).

Preferably, the moving means comprises a rotation shaft extending parallel to the shaft pin and mounted in the casing for movement up and down along with the casing, a rotation arm connecting the rotation shaft and the shaft pin together, and means for rotating the rotation shaft relative to the shaft pin to move the casing up and down.

Preferably, the rotating means comprises an operating lever extending radially from the rotation shaft, and a driving means for rotating the operating lever.

Preferably, the driving means comprises an adjusting knob disposed on the casing, having a shaft with a spiral groove formed in the outer circumference thereof and a handle provided at s first end of the shaft for rotating the shaft, and a slider member having a spiral rib on the inner circumference thereof engaging the spiral groove of said shaft and being mounted so as to move up and down along said shaft, responsive to rotation of said shaft, to thereby cause rotation of the operating lever.

Preferably, an engagement projection is provided at one end of the slider and is adapted to be engaged with the operating lever.

Preferably, the driving means further comprises a coil spring having a first end connected to the operating lever and a second end connected to a bottom wall of the casing, for resiliently biasing the operating lever in a upwardly direction away from the said bottom wall.

Preferably, the driving means further comprises rotational angle adjusting means for adjusting the rotational angle of the shaft. Preferably, the rotational angle adjusting means includes an adjusting protrusion extending outwardly from the second end of the shaft, and an adjusting protrusion receiving member provided in the casing and including a plurality of adjusting grooves for receiving the adjusting protrusion.

In accordance with a further aspect of the invention, a vacuum cleaner suction nozzle is provided wherein the unit comprises: a casing having a front end and a rear end, and including first and second front wheels at the front end of the casing, and at least one wheel located at the rear end of the casing and defining a rotation axis; first and second shaft pins for supporting said first and second front wheels for rotation about said first and second shaft pins, respectively; a shaft connecting said shaft pins together and being rotatable about said shaft pins; coupling means for coupling said shaft to said casing so that rotation of said shaft about said shaft pins produces pivoting of the casing about the axis of said at least one rear wheel and resultant elevation of the front end of said casing; and operator controlled control means for providing selected rotation of said shaft about said shaft pins to produce selected elevation of said front end of said casing.

Further features and advantages of the present invention will be set forth in, or apparent from, the detailed description of preferred embodiments thereof which follows.

DESCRIPTION OF THE PREFERRED EMBODIMENTS

Figure 1:
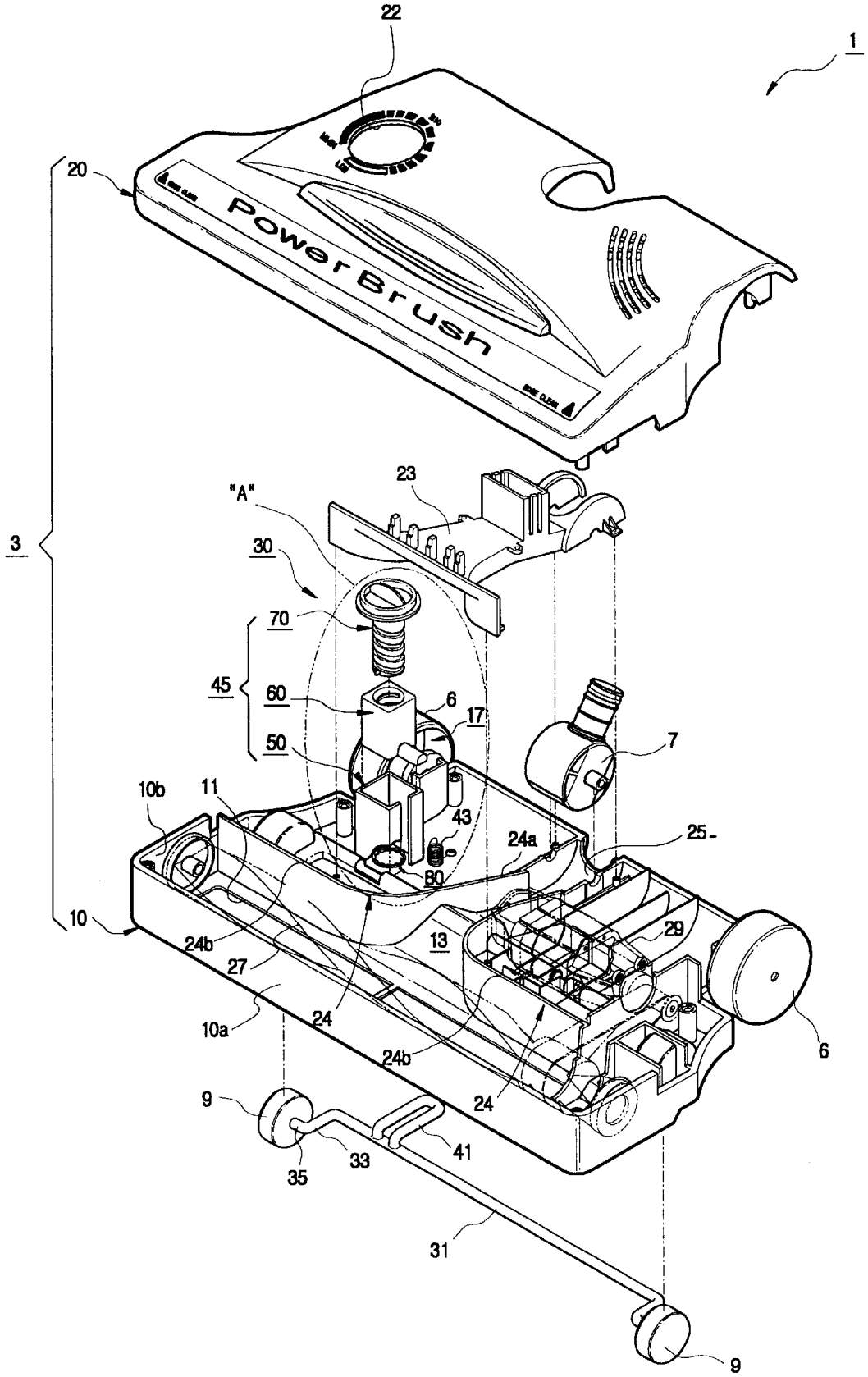
FIG. 1 is an exploded perspective view of a suction nozzle unit for a vacuum cleaner according to the present invention.
Figure 2:
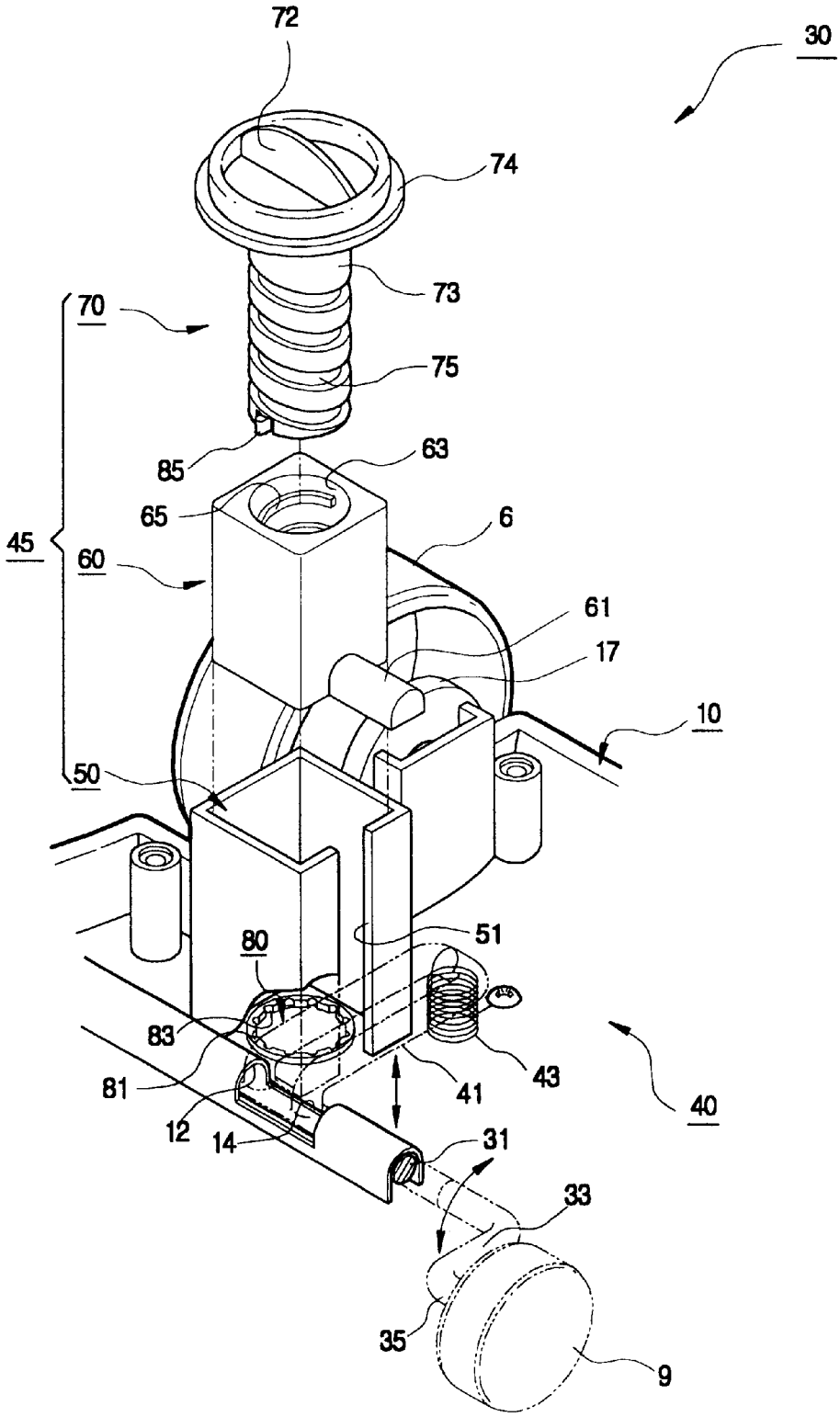
FIG. 2 is an enlarged perspective view of the part "A" of the suction nozzle unit in FIG. 1, indicated at "A" in FIG. 1.
Figure 3:
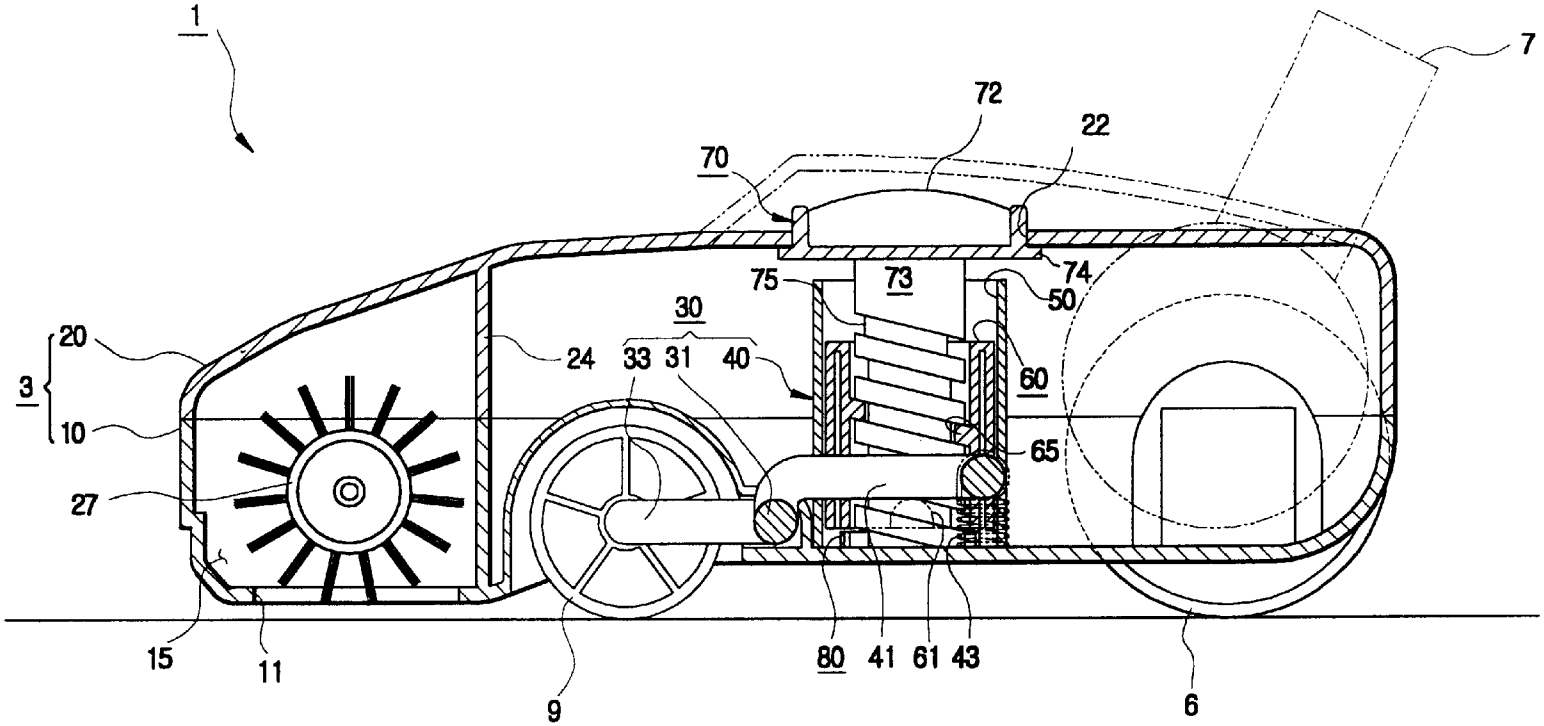
FIG. 3 is a side elevational view, partially in cross section, of suction nozzle unit of FIG. 1.
Figure 5:
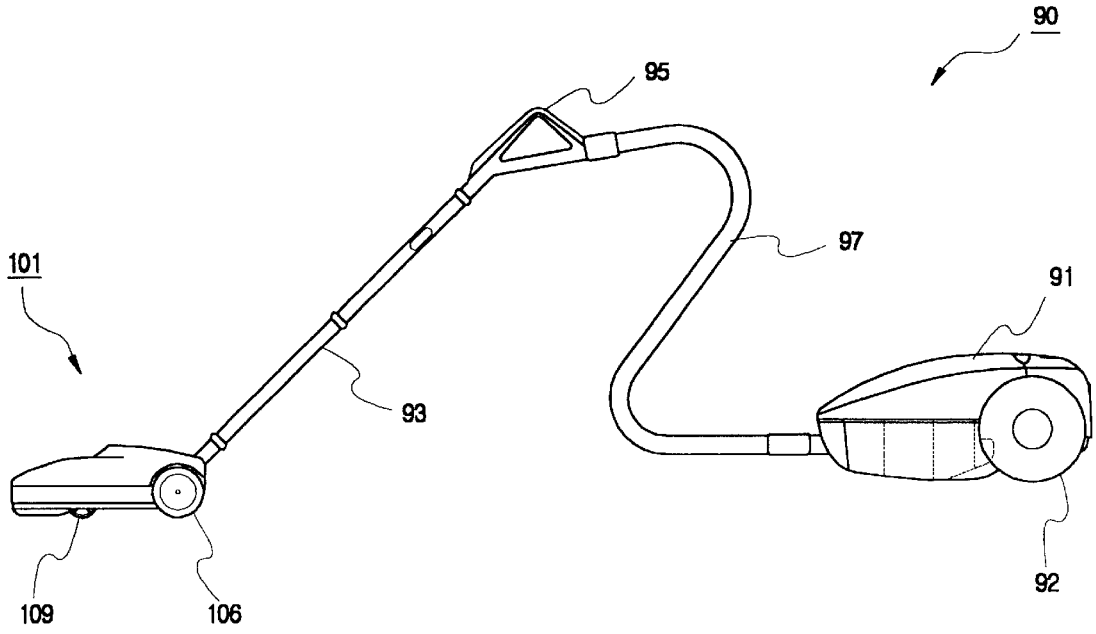
FIG. 5 (PRIOR ART)
FIG. 5 which was described above, is a schematic side elevational view of a conventional vacuum cleaner.
Figure 6:
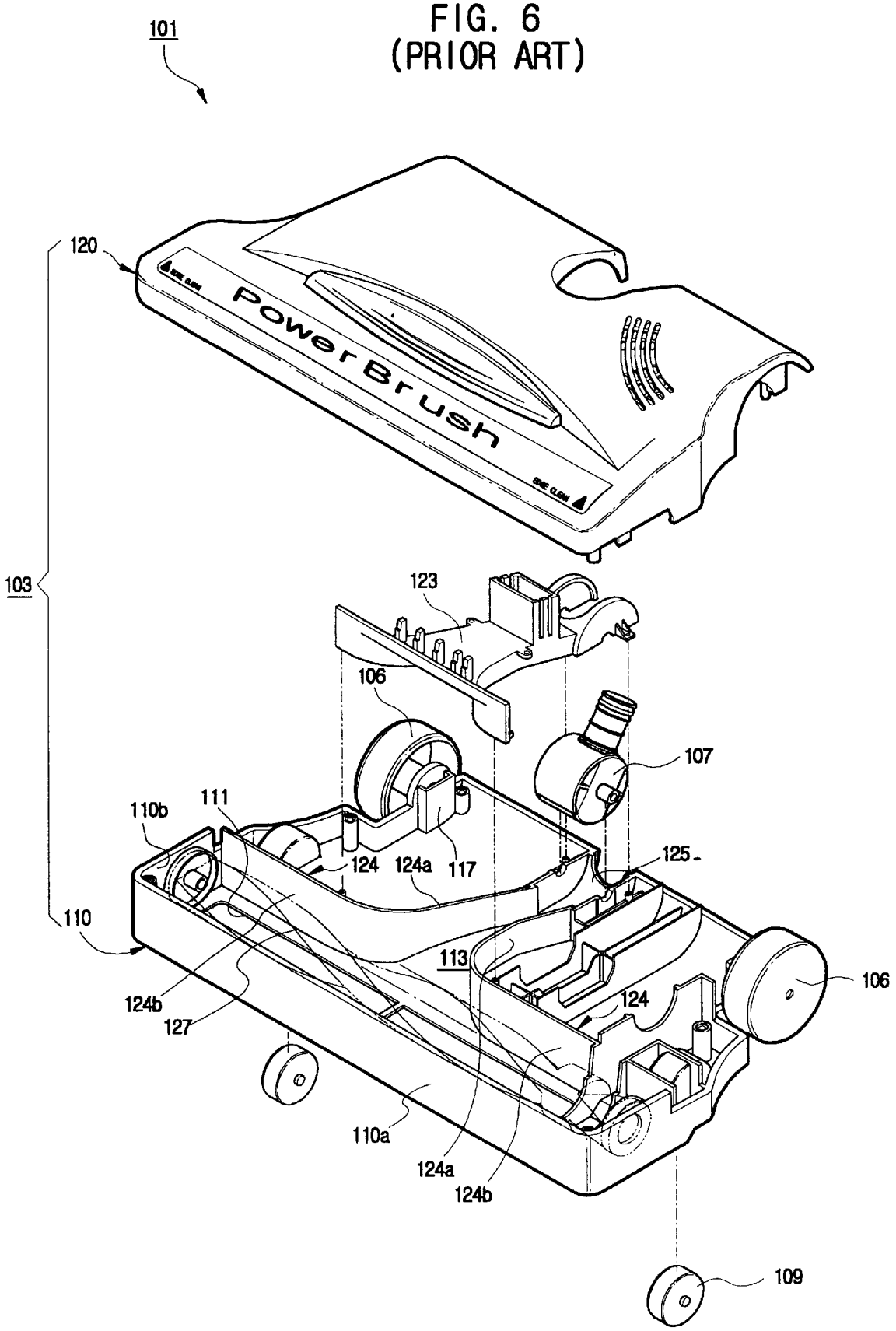
FIG. 6 (PRIOR ART)
FIG. 6 which was described above, is an exploded perspective view of a conventional suction nozzle unit for a vacuum cleaner.
Figure 7:
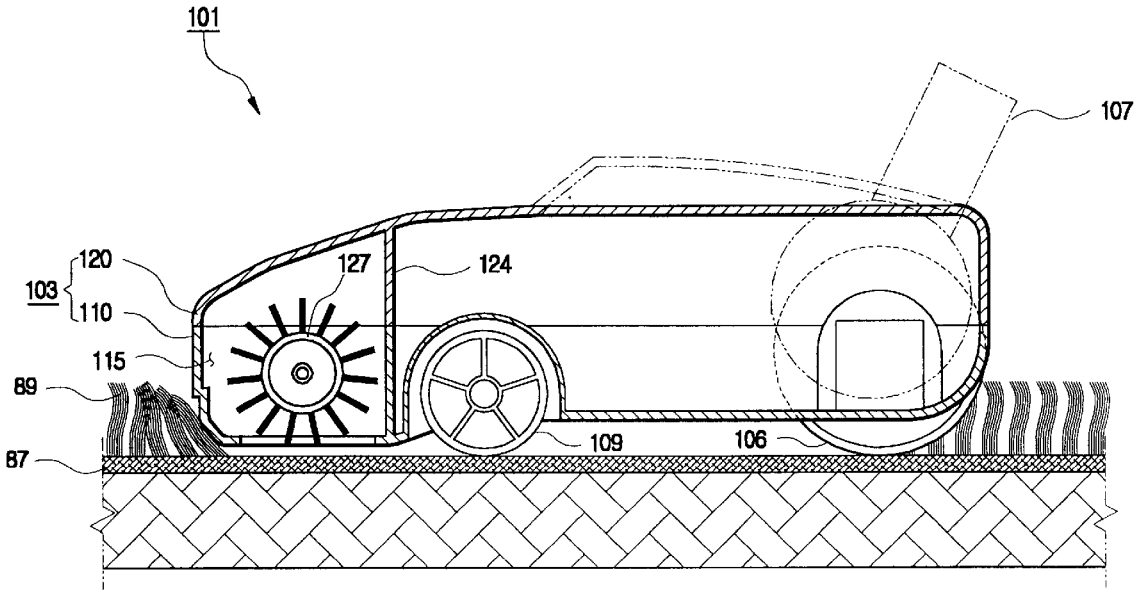
FIG. 7 (PRIOR ART)
FIG. 7 which was described above, is a side elevational view, partially in cross section, of the conventional suction nozzle unit of FIG. 6.

Referring to FIGS. 1 to 3, there is shown a suction nozzle unit 1 for a vacuum cleaner constructed according to a preferred embodiment the present invention and comprised of a casing or housing 3 defining the external appearance of the unit 1, respective pairs of front wheels 9 and rear wheels 6 for enabling the suction nozzle unit 1 to be moved over the surface to be cleaned, and a connector 7 to which a suction pipe (corresponding to the suction pipe 93 of FIG. 5) is coupled.

The casing 3 is comprised of a lower casing 10, and an upper casing 20 when covers the lower casing 10. In the front bottom part of the lower casing 10 is formed a suction inlet 11 for sucking dust and debris from the surface to be cleaned.

In the back of the suction inlet 11 are located a pair of oppositely disposed, substantially L-shaped partitioning walls 24. Between side wall portions 24*a* of the partitioning walls 24 is formed a suction duct 13 which serves as a passageway for the dust and debris sucked through the suction inlet 11. The top of the suction duct 13 is covered with a duct cover 23. In the back of the suction duct 13 is positioned a connector receiving part 25 for rotatably receiving the connector 7. In a part of the upper casing 20 covering the lower casing 10 is provided an opening or aperture 22 through which extends an adjusting knob 72 for a driving part 45 will be described later.

Figure 4:
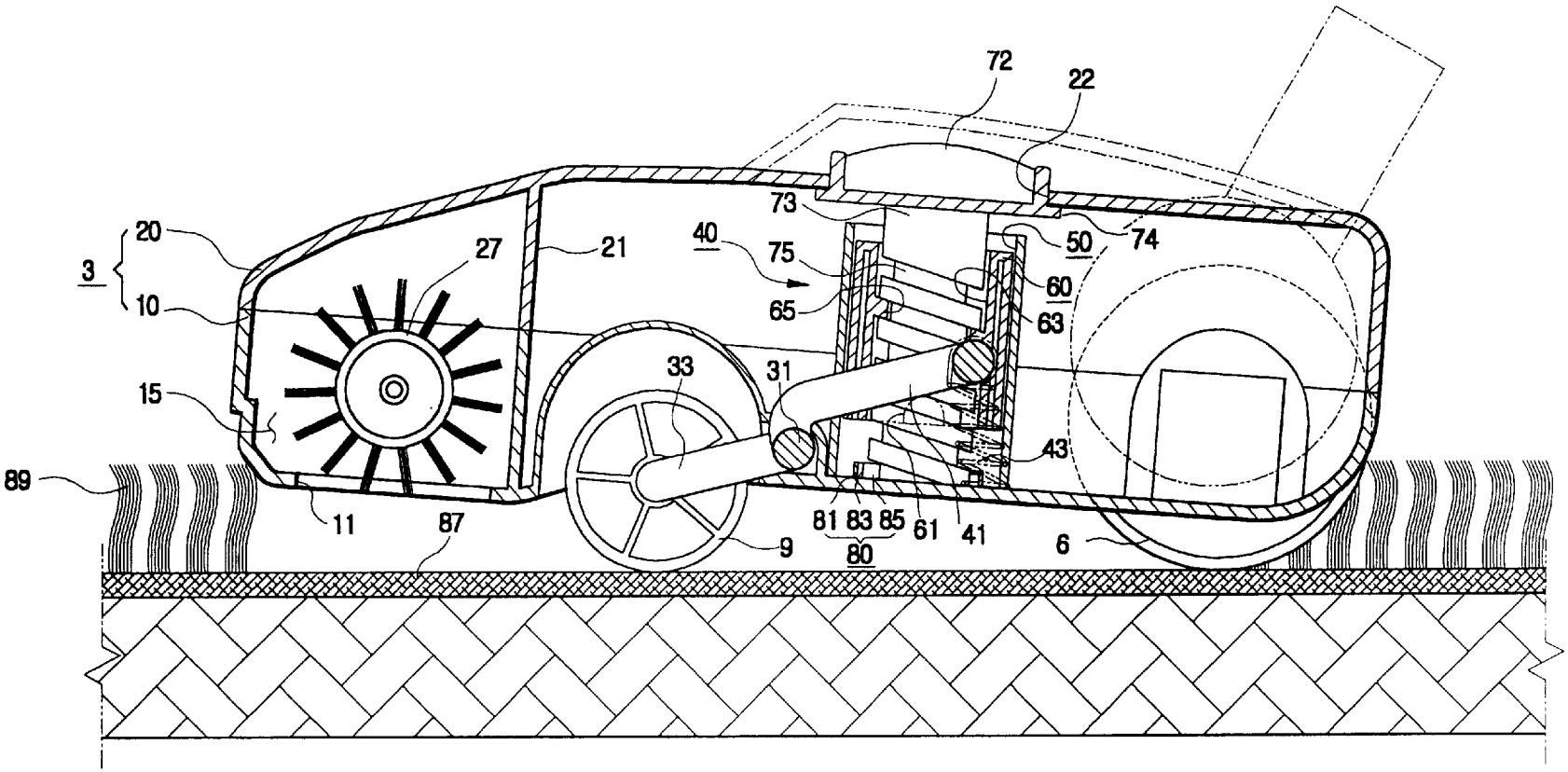
FIG. 4 is a side elevational view, partially in cross section, of the elevated state of the suction nozzle unit of FIG. 3.

Between a front wall 10*a* and side walls 10*b* of the lower casing 10, and front wall portions 24*b* of the partitioning walls 24 is formed a brush receiving part 15 in which is rotatably installed a brush member 27 for removing dust and debris from a carpet 87 as shown in FIG. 4. The brush member 27 is rotated by a brush motor (not shown).

The rear wheels 6 disposed at the rear side walls of the lower casing 10 are coupled to wheel coupling parts 17 so as to roll along a carpeted surface to be cleaned. The front wheels 9 disposed at the front side walls of the lower casing 10 are supported by shaft pins 35 so as to roll along a carpeted surface. Relative up and down movement between the shaft pins 35 and the lower casing 10 is provided by an elevating mechanism 30. More particularly, as referenced to the surface to be cleaned, the lower casing 10 is caused to move up and down relative to the shaft pins 35.

As shown in FIG. 2, the elevating mechanism 30 is comprised of a rotation shaft 31, rotation arms 33 and a rotation mechanism generally denoted 40. The rotation shaft 31 is rotatably installed in a shaft housing part 12 formed on a bottom portion of the lower casing 10, and extends parallel to the shaft pins 35 which rotatably support the front wheels 9. The rotation arms 33 connect respective ends of the rotation shaft 31 to the shaft pins 35. The rotation mechanism 40 rotates the rotation shaft 31 so that the rotation arms 33 rotate about shaft pins 35 and the ends of arms 33 connected to rotation shaft 31 move up and down relative to shaft pins 35. As a result, the front portion of the lower casing 10 moves up and down relative to the surface to be cleaned. Preferably, the rotation shaft 31, the rotation arms 33 and the shaft pins 35 are formed integrally in the shape of crankshaft.

The rotation mechanism 40 is comprised of an operating lever 41 and a driving part 45 for driving the operating lever 41. The operating lever 41 is extends perpendicular to the rotation shaft 31 and projects to the backside of the lower casing 10 from the rotation shaft 31 through an opening 14 formed by cutting out an upper part of the shaft housing part 12.

The driving part 45 is comprised of a slider receiving element 50 which extends vertically with respect to the lower casing 10 adjacent to the operating lever 41, a slider member 60 slidably received in the slider receiving element 50 so as to rotate the operating lever 41 in response to the sliding movement thereof, and an adjusting knob 70 for adjusting the sliding movement of the slider member 60.

The slider receiving element 50 has a rectangular cross section and is open at the top thereof. A vertical guide slit 51 is formed in one side wall of the slider receiving element 50, and faces the operating lever 41.

The slider member 60 has the shape of rectangular column, and along the center line thereof, a through hole or opening 63 is formed. On the lower part of the slider 60, opposite to the guide slit 51 of the slider receiving element 50 is formed an engagement protrusion or projection adapted to engage the operating lever 41, and extending through the guide slit 51 of the slider receiving elements 50. A spiral rib or thread 65 is formed on the inner circumference of the through hole 63 in the slider 60.

The adjusting knob 70 comprises a spiral or threaded shaft 73 and a handle 72 located at the top of the spiral shaft 73 for adjusting the rotation of the spiral shaft 73. The shaft 73 has a spiral groove 75 at its outer circumference corresponding to the spiral rib 65 of the slider member 60, and moves up and down in the through hole 63 of the slider 60. A flange 74 is formed between the shaft 73 and the handle 72. The lower surface of the flange 74 contacts the periphery of the hole 22 in the upper casing 20, so that the movement of the adjusting knob 70 is prevented. With this arrangement, when the spiral shaft 73 rotates relative to the slider member 60, the slider member 60 moves up and down in the slider receiving element 50. In response to this movement, the engagement protrusion or projection 61 of the slider member 60 moves up and down along the guide slit 51 to rotate the operating lever 41 and to thus rotate the rotation shaft 31 and lift or lower the ends of the rotation arms 33 connected thereto, as shown in FIGS. 3 and 4. Casing 3 pivots around the axis of the rear wheels 6 and, as a result, the front part of the lower casing 10 moves up and down relative to the front wheels 9 and to the surface to be cleaned.

At the location of the slider receiving element 50 and the knob 70 is formed a rotational angle adjusting member 80 for adjusting a rotational angle of the knob 70 so as to adjust the amount of the relative movement provided wherein the front wheels 9 to the lower casing 10. The rotational angle adjusting member 80 comprises an annular adjusting protrusion receiving element 81 provided on the bottom face of the slider receiving element 50. Element 81 engages a lower part of the spiral shaft 73 of the adjusting knob 70, and has a plurality of adjusting grooves 83 formed at uniformly paced intervals around the inner circumference thereof. An adjusting projection or protrusion 85 radially protrudes from a lower part of the spiral shaft 73 to engage with the adjusting grooves 83 of element 81.

In the operation of the rotational angle adjusting member 80, the adjusting protrusion 85 of the spiral shaft 73 engaged with one of adjusting groove 83 is caused to resiliently or elastically engage the next adjacent adjusting groove 83 of the adjusting protrusion receiving element 81 when the adjusting knob 70 is rotated by the user, so that the slider 60 moves by a desired distance. In this way, adjustment is provided of the movement of the lower casing 10 relative to the front wheels 9.

The operating lever 41, operated by the driving part 45, is resiliently or elastically biased upwards by a compression coil spring 43. The end of the coil spring 43 are respectively coupled to one end of the operating lever 41 and the bottom of the lower casing 10. With this coupling arrangement, the coil spring 43 is extended upwardly when the operating lever 41 is moved upwardly in response according to the elevation of the slider 60 of the driving part 45, and is compressed when the slider 60 of the driving part 45 is moved downwardly.

In operation, and assuming that the casing 3 is in the position shown in FIG. 3, when the handle 72 of the adjusting knob 70 is rotated in a first rotational direction, the spiral shaft 73 of the adjusting knob 70 is for example, rotated clockwise relative to the slider member 60 and the slider member 60 is slidably moved upwardly within the slider 60 the slider receiving element 50. The engagement protrusion 61 of the lower part of the slider 60 also moves upwardly, so that the operating lever 41, which is connected to the rotation shaft 31, rotates upwardly in response to the restoring force produced by the coil spring 43. As the rotation shaft 31 rotates upwardly together with the operating lever 41, the rotation arms 33 also rotate upwardly. Accordingly, the front part of the lower casing 10, which includes the suction inlet 11, is separated from the surface 87 to be cleaned, as shown in FIG. 4.

At this time, the adjusting protrusion or projection 85 of the spiral shaft 73 of the adjusting knob 70 is released from engagement with the adjusting grooves 83 of the adjusting protrusion receiving member 81 and rotates therein. If the user stops rotation of the knob 70, the adjusting protrusion 85 becomes engaged with one of the plurality of adjusting grooves 83. In this manner, the movement of the slider 60 relative to the knob 70, and thus, the relative movement of the front part of the lower casing 10 with respect to the surface to be cleaned can be adjusted as desired.

If the adjusting knob 70 is rotated in the second, opposite direction, that is, counterclockwise, the slider 60 and the engagement protrusion 61 thereof, move downwardly, and the operating lever 41 also moves downwards compressing the coil spring 43. The front part of the lower casing 10 then moves toward the front wheels 9 and the surface to be cleaned, and the distance or spacing between the lower casing 10 and the surface to be cleaned is made smaller.

According to the present invention, because the front part of the lower casing 10 can be elevated from the surface to be cleaned depending on the length of the pile 89 of the carpet 87, as illustrated in FIG. 4, the resistance created when the carpet fibers 89 of the carpet 87 are pulled under the front bottom part of the lower casing in the conventional suction nozzle unit can be prevented, thereby improving the movability of the suction nozzle unit.

In the above-described embodiments, the elevating mechanism is comprised of the rotation shaft, the rotation arms, the operating lever, the adjusting knob and the slider. In an alternative, non-illustrated embodiment, the elevating mechanism can be comprised of a rack coupled to the shaft pin, a pinion engaged with the rack, and a driving motor for driving the pinion. A solenoid (not shown) can also be used to provide the driving force for the elevating mechanism. The shaft pin may also be installed to slidably move in the casing of the suction nozzle unit.

Although the present invention has been described in connection with a preferred embodiments thereof, it will be appreciated by those skilled in the art that additions, modifications, substitutions and deletions not specifically described hereinabove can be made in this embodiment without departing from the spirit and scope of the invention.

What is claimed is:

1. A suction nozzle unit for a vacuum cleaner, said suction nozzle unit being movable over a surface to be vacuumed and comprising a casing having a front and a rear and including a suction inlet, a pair of front wheels located in the front of the casing and a pair of rear wheels installed in the rear of the casing, the suction nozzle unit further comprising:

shaft pins for rotatably supporting said front wheels; and moving means for providing relative up and down movement between said casing and said shaft pins so as to vary the height of the casing relative to the surface to be vacuumed, said moving means comprising a rotation shaft extending parallel to said shaft pins and mounted in said casing for movement up and down with said casing;

rotation arms connecting said rotation shaft and said shaft pins; and shaft rotation means for rotating said shaft pins relative to said rotation shaft so as to cause said casing to move up and down, said shaft rotation means comprising an operating lever extending radially from said rotation shaft; and a driving means for rotating said operating lever, said driving means comprising an adjusting knob disposed on said casing and including a spiral shaft having an outer circumference including a spiral groove and a handle at a first end of said spiral shaft for rotating said spiral shaft; and a slider member including an inner circumference having a spiral rib therein engaging in the spiral groove of the spiral shaft of said adjusting knob and being mounted on said casing so as to move up and down along said groove in response to the rotation of said spiral shaft, thereby to cause rotation of said operating lever.

2. The suction nozzle unit according to claim 1, wherein said slider member includes an end portion including an engagement projection adapted to be engaged with said operating lever.

3. The suction nozzle unit according to claim 1, wherein said driving means further comprises a coil spring, having a first end connected to said operating lever and a second end connected to said casing, for resiliently biasing said operating lever into an inoperative position.

4. The suction nozzle unit according to claim 1, wherein said driving means further comprises a coil spring, having a first end part connected to said operating lever and a second end part connected to a bottom wall of said casing, for resiliently biasing said operating lever upwardly away from said bottom wall of the casing.

5. The suction nozzle unit according to claim 1, wherein said driving means further comprises rotational angle adjusting means for adjusting the angle of rotation of said knob shaft.

6. The suction nozzle unit according to claim 5, wherein said rotational angle adjusting means includes a protrusion extending outwardly from a second end of said knob shaft, and a projection receiving member provided in said casing and including a plurality of adjusting grooves for receiving said protrusion.

* * * * *